US011370145B2

(12) United States Patent
Crondahl et al.

(10) Patent No.: US 11,370,145 B2
(45) Date of Patent: Jun. 28, 2022

(54) SYSTEMS AND METHODS FOR DRYING WOOD PRODUCTS

(71) Applicant: Westmill Industries Ltd., Aldergrove (CA)

(72) Inventors: Michael Crondahl, Mission (CA); Christian Gollmann, Eugene, OR (US)

(73) Assignee: Westmill Industries Ltd., Aldergrove (CA)

( * ) Notice: Subject to any disclaimer, the term of this patent is extended or adjusted under 35 U.S.C. 154(b) by 0 days.

(21) Appl. No.: 17/018,929

(22) Filed: Sep. 11, 2020

(65) Prior Publication Data

US 2021/0078199 A1 Mar. 18, 2021

Related U.S. Application Data

(60) Provisional application No. 62/900,026, filed on Sep. 13, 2019.

(51) Int. Cl.
*B27K 3/02* (2006.01)
*B27K 3/08* (2006.01)

(52) U.S. Cl.
CPC ..... *B27K 3/0207* (2013.01); *B27K 3/08* (2013.01)

(58) Field of Classification Search
CPC .. B27K 3/0207; B27K 3/0214; B27K 3/0221; B27K 3/08; B27K 3/0285; B27K 3/0292; B27K 5/001; B27K 5/003; B27K 5/005; F26B 3/28; F26B 3/283; F26B 3/286; F26B 3/30
See application file for complete search history.

(56) References Cited

U.S. PATENT DOCUMENTS

| | | | | |
|---|---|---|---|---|
| 7,070,676 | B2 | 7/2006 | Churchland et al. | |
| 10,006,712 | B2 | 6/2018 | Crondahl et al. | |
| 2016/0061521 | A1 | 3/2016 | McMahon et al. | |
| 2019/0084181 | A1* | 3/2019 | Tran Hoai | B27K 3/0214 |

FOREIGN PATENT DOCUMENTS

WO WO-8808949 A1 * 11/1988 ..... F26B 3/283

OTHER PUBLICATIONS

Freres Lumber Co., Inc., Mass Plywood Panel. http://frereslumber.com/products-and-services/mass-plywood-panel/, Accessed Dec. 10, 2020.

* cited by examiner

*Primary Examiner* — Michael P Wieczorek

(74) *Attorney, Agent, or Firm* — Oyen Wiggs Green & Mutala LLP

(57) ABSTRACT

Systems and methods for treating wood products are provided. The methods comprise preconditioning the wood product by irradiating one or more surfaces of the wood product with infrared (IR) and/or ultraviolet (UV) radiation and subsequently treating the wood product. The systems comprise one or more fixtures positioned to irradiate one or more surfaces of the wood product with IR and/or UV radiation, wherein each fixture comprises a reflector and a radiation source.

11 Claims, 9 Drawing Sheets

SYSTEMS AND METHODS FOR DRYING WOOD PRODUCTS

TECHNICAL FIELD

The present invention relates to systems and methods for reducing the moisture content of wood products. Particular embodiments relate to systems and methods for reducing the moisture content of a wood product by radiating the surface of the wood product with ultraviolet (UV) and/or infrared (IR) radiation.

BACKGROUND

Single and multiple deck conveyor dryers for reducing the moisture content of sheet materials (including green (i.e. wet) wood veneer) and composite materials, wherein the material being dried is conveyed through a stationary drying chamber while heated gases are circulated through the drying chamber, are well-known in the art. Drying conditions and conveying speeds are typically optimized to produce a high yield of satisfactorily dried veneer and limit the amount of unusable veneer that is 'overdry'. In limiting the amount of veneer that is overdry, some veneer exiting the dryer will have a moisture content that makes it unsuitable for immediate use in wood composite products, such as plywood. This is because excess moisture in the veneer will cause layers in the composite product to delaminate. Veneer exiting the dryer with excess moisture content is often referred to as 'redry'.

It is common practice to set drying conditions and conveying speeds to yield up to about 30% redry veneer. The redry is collected and stored until it can be passed again through the dryer or to another dryer. In either situation, the drying conditions and conveying speeds must be tailored to yield usable veneer from the redry veneer. Often, losses occur. The redry is typically more brittle than green veneer and less capable of handling the mechanical stresses from a dryer without chipping and/or otherwise becoming damaged. In addition to veneer losses, drying redry consumes valuable dryer time and impacts ultimate veneer productivity.

Veneer losses are also commonly experienced when cooler wood veneer enters a dryer or dryer section that is much hotter than the veneer. If too much heat is applied at once, pressure quickly builds up as steam is produced, thereby rupturing the cell structure of the veneer. In some instances, this causes the surface of the veneer to harden, sealing moisture inside the veneer. Thus, drying conditions are commonly optimized to limit 'case-hardening'. Case-hardening may inhibit the bonding of resins or glues to dry wood veneer during lamination processes.

Systems and processes for forming a composite wood product are also known. For example, radiofrequency (RF) or microwave (MW) radiation have been used with press assemblies to heat and cure a composite of resin-coated wood veneer. Many of the known processes that use RF energy are unable to distribute heat evenly throughout the product to be treated. Attempts to heat and cure such products with IR often cause the surface to burn. Processes that use MW energy also experience drawbacks. For example, systems for forming composite wood products and the components thereof typically are formed of metal, which reflect MW energy. MW energy may leak from these systems and expose operators to radiation with accompanying health risks. Accordingly, additional equipment is needed to minimize and/or prevent MW energy from leaking from these systems. Such equipment adds space to such systems, which adds treatment time to continuous processes. Further, additional equipment requirements can add expense.

There is a general desire to produce high quality wood products and/or reduce one or more of wood product losses, energy losses, the amount of redry, and the costs associated with wood product treatment (e.g. veneer drying, wood composite product production, etc.).

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

An aspect of the invention provides a method for treating a wood product. The method comprises preconditioning the wood product by irradiating one or more surfaces of the wood product with infrared (IR) and/or ultraviolet (UV) radiation and subsequently treating the wood product.

In some embodiments, the one or more surfaces of the wood product is first irradiated with IR radiation and subsequently irradiated with UV radiation.

In some embodiments, the one or more surfaces of the wood product is first irradiated with UV radiation and subsequently irradiated with IR radiation.

In some embodiments, the one or more surfaces of the wood product is irradiated with IR radiation and UV radiation simultaneously.

In some embodiments, the one or more surfaces of the wood product is irradiated with IR radiation for a time sufficient to distribute moisture throughout the wood product and/or the one or more surfaces of the wood product.

In some embodiments, the one or more surfaces of the wood product is irradiated with UV radiation for a time sufficient to distribute moisture throughout the wood product and/or the one or more surfaces of the wood product.

The method according to claim 1, wherein the one or more surfaces of the wood product is irradiated with UV radiation for a time sufficient to distribute moisture throughout the wood product and/or the one or more surfaces of the wood product.

The method according to claim 1, wherein one or more areas of the one or more surfaces of the wood product is irradiated with IR radiation for a time sufficient to distribute moisture throughout the wood product and/or the one or more surfaces of the wood product.

In some embodiments, subsequently treating the wood product comprises one or more of drying, heating, curing, coating, and pressure-treating.

In some embodiments, the wood product comprises one or more of green wood veneer, redry wood veneer, plywood, particleboard, fiberboard, hardboard, oriented strand board, laminated timber, laminated veneer, cross laminated, parallel strand, laminated strand, finger joint, beams, trusses, transparent wood composites, wood-concrete composites, wood-plastic composites (WPCs), and wood gypsum composites.

In some embodiments, the method further comprises determining the amount of moisture in the wood product prior to irradiating the one or more surfaces of the wood product.

In some embodiments, the amount of moisture in the wood product is greater than or equal to about 10% by weight.

In some embodiments, irradiating the one or more surfaces of the wood product comprises varying the energy intensity of the UV and/or IR radiation depending on the amount of moisture in the wood product.

Another aspect of the invention provides a preconditioning system for treating a wood product. The system comprises one or more fixtures positioned to irradiate one or more surfaces of the wood product with IR and/or UV radiation, wherein each fixture comprises a reflector and a radiation source.

In some embodiments, the one or more fixtures are positioned to irradiate a top surface of the wood product.

In some embodiments, the one or more fixture are positioned to irradiate a bottom surface of the wood product.

In some embodiments, the radiation source emits electromagnetic radiation having a wavelength of about $1\times10^{-6}$ m to about $4\times10^{-6}$ m and/or about $7\times10^{-7}$ m to about $1\times10^{-3}$ m.

In some embodiments, the radiation source generates a temperature of about 200° C. inside the system.

In some embodiments, the radiation source comprises a quartz bulb.

In some embodiments, the radiation source comprises or quartz lamp.

In some embodiments, the radiation source comprises a gas-fired infrared heater.

In some embodiments, the radiation source comprises a microwave oscillator tube.

In some embodiments, the reflector comprises a parabolic reflector.

In some embodiments, each fixture is about 6 inches (i.e. about 15 cm) apart from each adjacent fixture.

In some embodiments, each fixture is about 3 inches or less (i.e. about 7.5 cm or less) from the surface of the wood product to be treated.

In some embodiments, the wood product comprises one or more of green wood veneer, redry wood veneer, plywood, particleboard, fiberboard, hardboard, oriented strand board, laminated timber, laminated veneer, cross laminated, parallel strand, laminated strand, finger joint, beams, trusses, transparent wood composites, wood-concrete composites, wood-plastic composites (WPCs), and wood gypsum composites.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Unless context dictates otherwise, "dryer" (as used herein) includes a conveyor-type dryer or oven, including, but not limited to, a wood veneer dryer, gypsum dryer, textile dryer, industrial dryer, and glass oven.

Unless context dictates otherwise, "input end" (as used herein in relation to a dryer and components thereof) means the end wherein a wood product to be treated is introduced into the dryer or component thereof.

Unless context dictates otherwise, "output end" (as used herein in relation to a dryer and components thereof) means the end opposite to the input end, i.e. the end wherefrom a treated material exits the dryer or component thereof.

Figure 2:
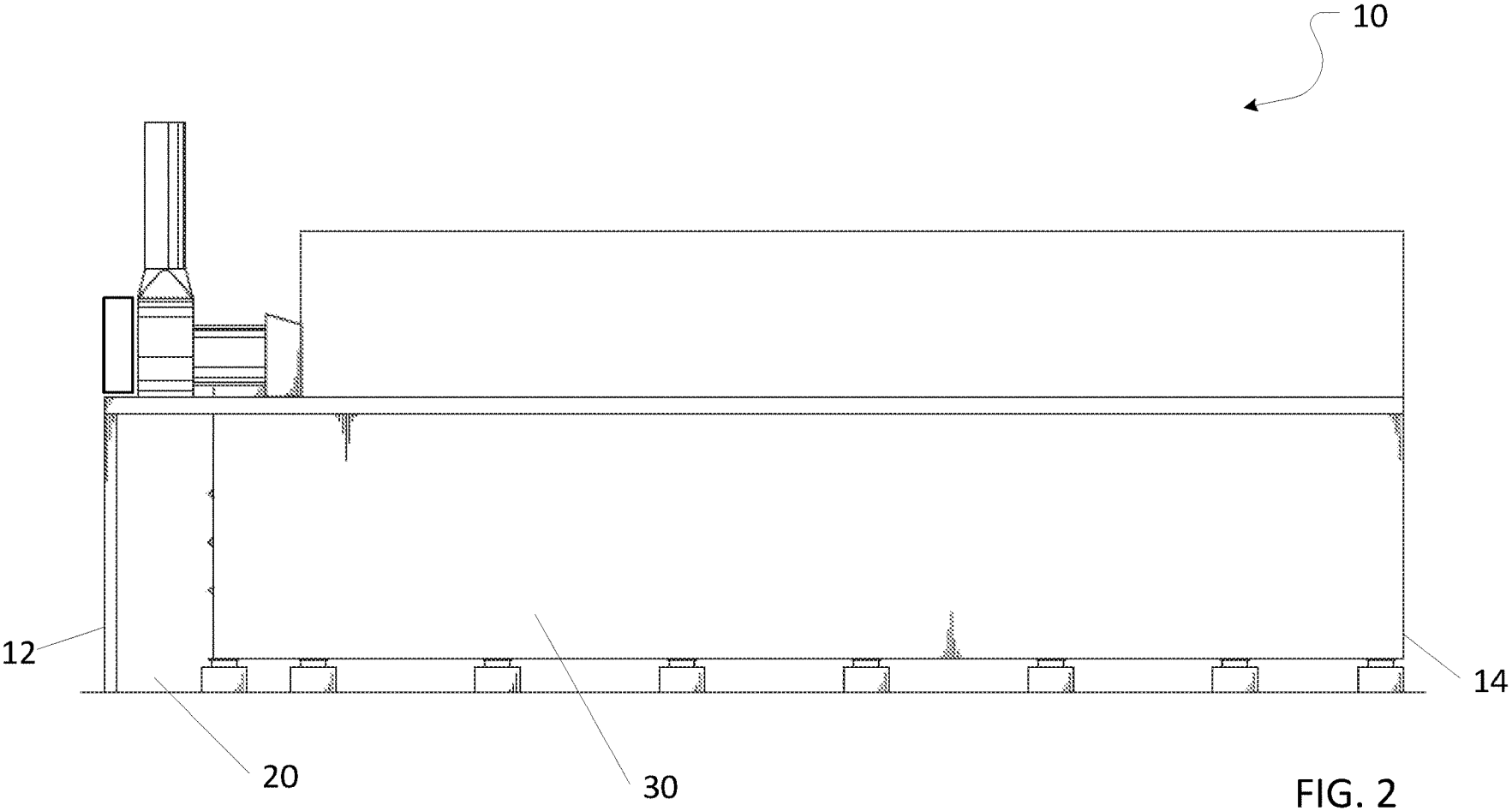
FIG. 2 PRIOR ART
FIG. 2 is a side elevation cross-sectional view of the wood veneer dryer shown in FIG. 1.

Unless context dictates otherwise, "direction of travel" (as used herein) means a direction in which a wood product to be treated travels from an input end to an output end of a dryer, i.e. the direction from left to right in view of the example embodiment shown in FIG. 2.

Unless context dictates otherwise, "treat", "treated", "treating," "treatment," and/or the like (as used herein) means industrially processed and includes, but is not limited to, one or more of dried, heated, cured, coating, and pressure-treated.

Unless context dictates otherwise, "wood" (as used herein) means one or of a cellulosic material, hemicellulosic material, and lignin-containing material. Wood is a porous and/or fibrous structural tissue found in the stems and/or roots of trees and/or other vegetative materials. Wood includes, but is not limited to, softwood, hardwood, bamboo, rye straw, wheat straw, rice straw, hemp, kenaf stalk, and sugar cane residue.

Unless context dictates otherwise, "composite wood product" (as used herein) means an engineered material consisting of wood that is manufactured by binding or fixing one or more of strands, particles, fibers, veneers, and boards of wood with one or more of adhesives, resins, and concrete. Composite wood products include, but are not limited to, plywood, particleboard, fiberboard, hardboard, oriented strand board, laminated timber, laminated veneer, cross laminated, parallel strand, laminated strand, finger joint, beams, trusses, transparent wood composites, wood-concrete composites, wood-plastic composites (WPC), and wood gypsum composites.

Unless context dictates otherwise, "wood-concrete composite" (as used herein) means an engineered material consisting of wood that is manufactured by binding or fixing one or more of strands, particles, fibers, veneers, and boards of wood with one or more slabs of concrete slabs.

Unless context dictates otherwise, "wood-plastic composite" (as used herein) means an engineered material consisting of wood that is manufactured by binding or fixing one or more of strands, particles, fibers, veneers, and boards of wood with a thermoplastic material (e.g. polyethylene (PE), polypropylene (PP), and polyvinylchloride (PVC), etc.).

Unless context dictates otherwise, "veneer" (as used herein) means a thin slice of wood. Veneer may have a thickness of between about 1.27 mm (about 1/20 inch) to about 4.23 mm (1/6 inch) (including any value therebetween). Veneer may have a thickness of less than about 3 mm (about 1/8 inch). Veneer may be used to produce WPCs.

Unless context dictates otherwise, "redry" means veneer that contains excess moisture after drying in a veneer dryer. The amount of allowable moisture in a sheet of "dry" veneer may depend on the type of glue or adhesive that will be used with the veneer post-drying. For example, some glues or adhesives can tolerate dry veneer having up to about 10% moisture content without the veneer's moisture content affecting the adhesive properties of the glue or adhesive to a significant extent. In some embodiments, "redry" means veneer that contains greater than or equal to about a 10% by weight moisture content.

Unless context dictates otherwise, "dry" means veneer that contains an allowable amount of moisture after drying in a veneer dryer. In some embodiments, "dry" means veneer that contains less than about a 10% by weight moisture content.

Unless context dictates otherwise, "wood product" (as used herein) means a material to be dried, including (but not limited to) sheet materials and composite wood products. Wood product includes, but is not limited to, wood-based products such as wood veneer (green and redry), wood-concrete composites, wood-plastic composites (WPCs), wood gypsum composites, etc.

Unless context dictates otherwise, "moisture" means a liquid including, but not limited to, water and a gas or vapour that is a liquid at room temperature, including, but not limited to, water vapour.

Unless context dictates otherwise, "electromagnetic radiation" means energy that is transmitted in waves or particles at different wavelengths and frequencies. The broad range of wavelengths is known as the electromagnetic spectrum. The spectrum is generally divided into seven regions. In order of decreasing wavelength and increasing energy and frequency, the regions are: radio waves, microwaves, infrared (IR), visible light, ultraviolet (UV), X-rays, and gamma-rays.

Unless context dictates otherwise, "infrared radiation" (as used herein) means electromagnetic (EM) radiation having frequencies from about $3\times10^{11}$ Hz to about $4\times10^{14}$ Hz and wavelengths of about $7\times10^{-7}$ m to about $1\times10^{-3}$ m.

Unless context dictates otherwise, "ultraviolet radiation" (as used herein) means EM radiation having frequencies from about $7.5\times10^{14}$ Hz to about $3\times10^{16}$ Hz and wavelengths of about $1\times10^{-8}$ m to about $4\times10^{-7}$ m.

Unless context dictates otherwise, "microwave radiation" (as used herein) means EM radiation having frequencies from about $3\times10^{9}$ Hz to about $3\times10^{11}$ Hz and wavelengths of about $1\times10^{-3}$ m to about $1\times10^{-1}$ m.

Unless context dictates otherwise, "radio wave radiation" (as used herein) means EM radiation having frequencies of less than about $3\times10^{9}$ Hz and wavelengths of greater than about $1\times10^{-1}$ m.

Unless context dictates otherwise, "uniform", "uniformly", and/or the like (as used herein) means substantially unchanging. For example, uniformly irradiating a wood product refers to the application of a substantially unchanging amount of radiant energy (e.g. IR and/or UV) (i.e. heat) to the wood product and/or its surface(s).

Unless context dictates otherwise, "even", "evenly", and/or the like (as used herein) means having little (i.e. within ±10% of the stated value) or no variation in quality, number, amount, or value.

Unless context dictates otherwise, "about" (as used herein) means near the stated value (i.e. within ±5% of the stated value).

Some embodiments of the present invention provide systems and methods for drying a wood product. The systems and methods uniformly irradiate the wood product and/or its surface(s) with infrared (IR) radiation and/or ultraviolet (UV) radiation to remove moisture from the wood product and/or its surface(s). In some embodiments, the present systems and methods prevent or minimize variable distribution of moisture in the treated wood product. By preconditioning a wood product with IR and/or UV radiation using the systems and methods described herein, treatment times may be reduced and/or subsequent treatment sections may be shortened and/or subsequent energy requirements may be reduced and/or subsequent treatment productivity may be improved and/or the quality of the treated wood product may be improved. The wood product to be treated may first be irradiated with IR radiation and then UV radiation. The wood product to be treated may first be irradiated with UV radiation and then IR radiation. In some embodiments, the wood product to be treated is irradiated with IR and UV radiation simultaneously.

Figure 1:
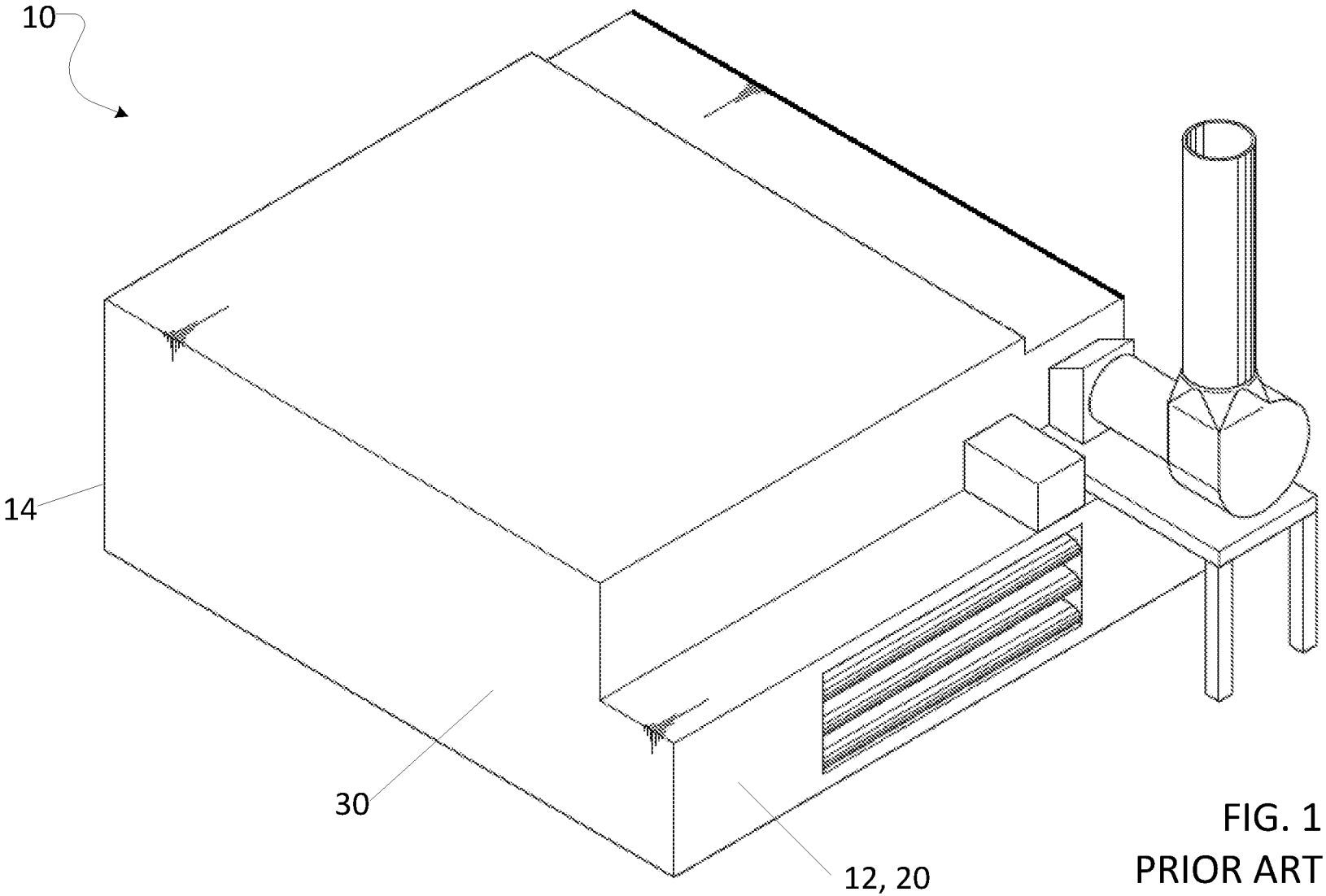
FIG. 1 PRIOR ART
FIG. 1 is a perspective view of a conventional wood veneer dryer.
Figure 3:
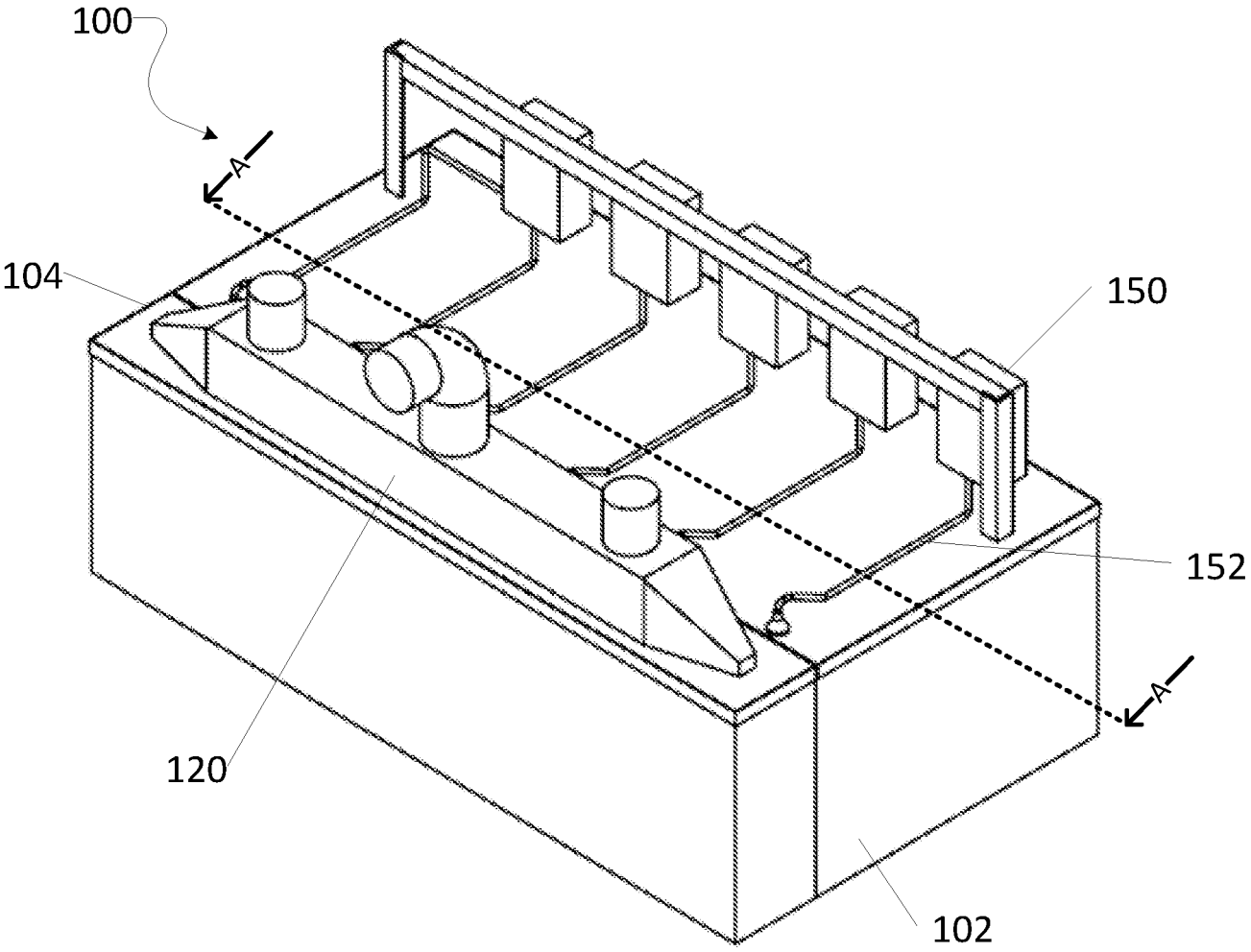
FIG. 3 is a perspective view of a system for preconditioning a wood product according to an example embodiment of the present invention.
Figure 4:
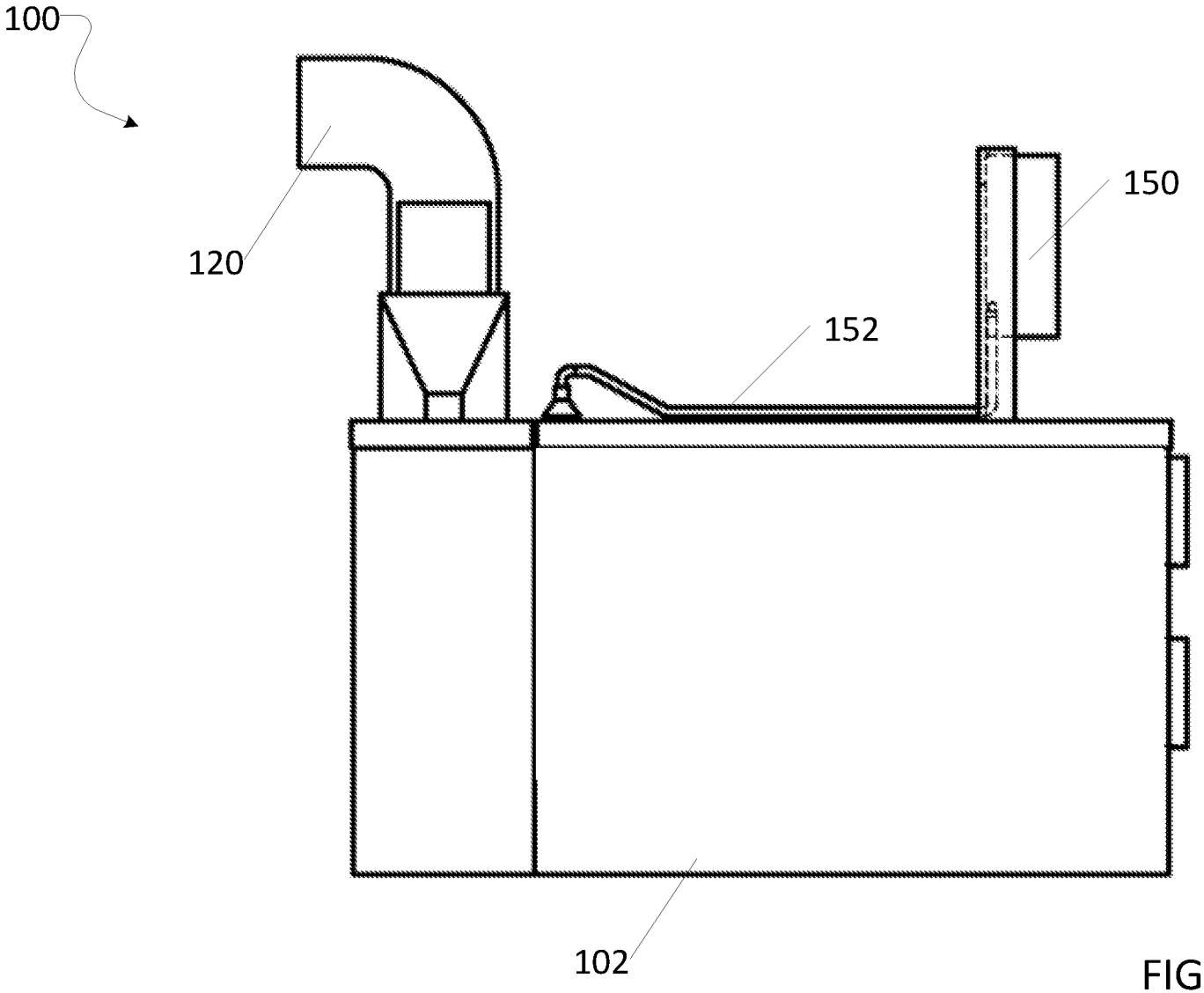
FIG. 4 is a front elevation view of the system shown in FIG. 3.
Figure 5:
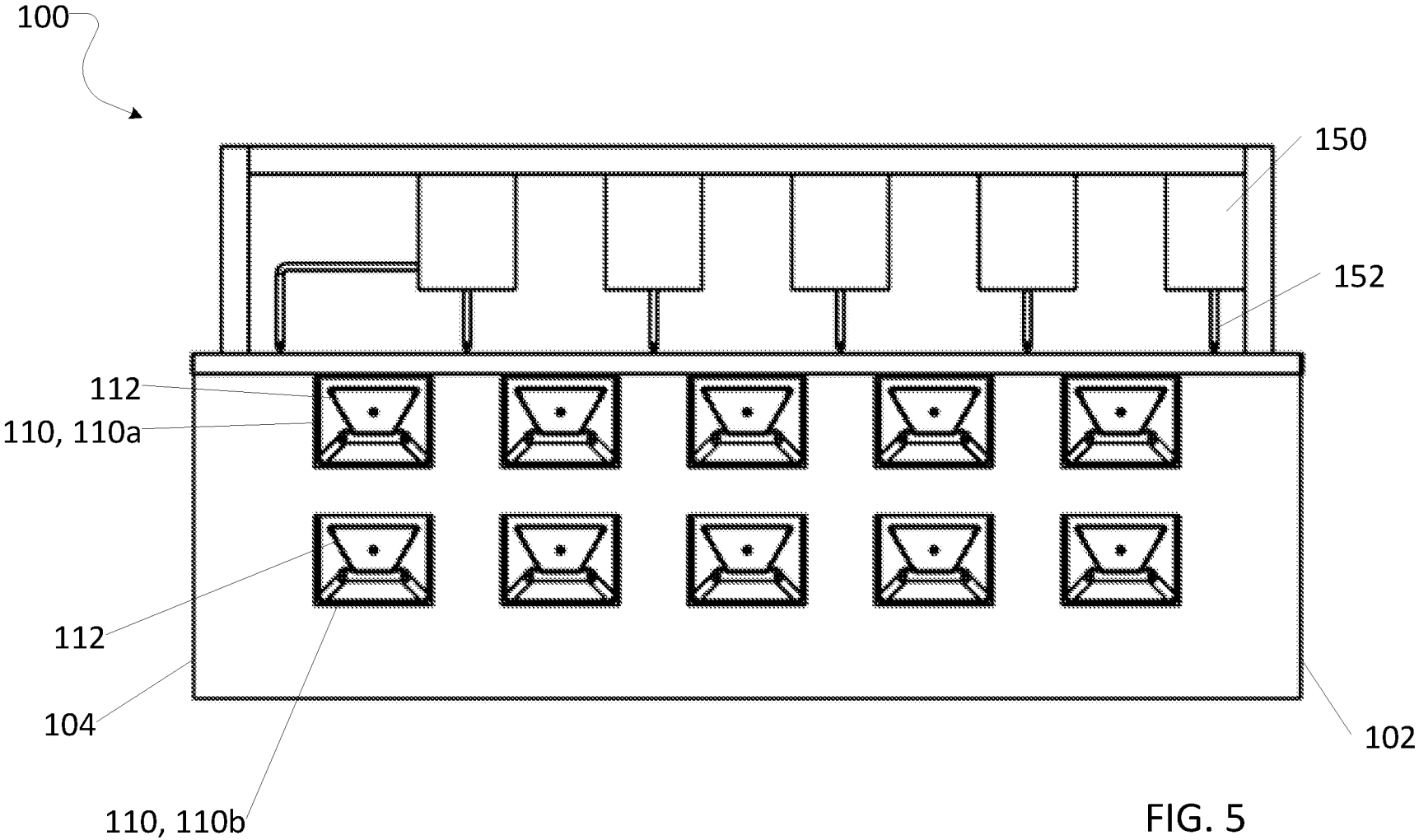
FIG. 5 is a cross-sectional view of the system shown in FIG. 3 taken along the line A-A.

A preconditioning system 100 in accordance with an example embodiment of the present invention is shown in FIGS. 3-5. System 100 may be installed for use with a dryer or other means for treating a wood product. For example, system 100 may be installed for use with a variety of conveyor- or non-conveyor-type dryers, such as (but not limited to) a conventional conveyor-type wood veneer dryer 10 shown in FIGS. 1 and 2. In some embodiments, system 100 is added to a prefabricated dryer. In some embodiments, a seal system is required to add system 100 to a prefabricated dryer to prevent heated gases and/or moisture from escaping system 100 and/or the prefabricated dryer. In some embodiments, system 100 is built into a dryer during dryer production.

A conventional veneer dryer, such as dryer 10, may include an input end seal section 20 connected to an input end 12 of an elongated drying section 30. A typical dryer may have several drying sections 30 aligned output end to input end. Green or undried veneer is introduced into dryer 10 at input end 12 of seal section 20 and then passes longitudinally through dryer 10 from input end 12 to an output end 14 through one or more drying sections 30. The veneer may pass through one or more conventional intermediary sections (not shown) and/or one or more conventional cooling sections (not shown) at output end 14 of drying section 30 before exiting dryer 10. As the veneer is conveyed through one or more drying sections 30, heated gases are circulated through each drying section. "Jet-type" veneer dryers are well-known in the art and include a heat source and a blower for each drying section 30. Jet-type dryers also include means, such as dryer nozzles, for directing heated air at localized points towards opposite faces of the veneer traveling through drying section 30. The heat of each drying section 30 removes moisture from the veneer and increases the volume of gases in the dryer. Typically, gases are removed using an exhaust system. System 100 may be installed at an input end 12 of input end seal section 20 to precondition veneer before the veneer enters dryer 10. In some embodiments, system 100 may be installed at an output end 14 of dryer 10 to reduce moisture in redry exiting the dryer.

A wood product is conveyed through system 100 and is subjected to infrared (IR) and/or ultraviolet (UV) radiation. A wood product to be treated (e.g. green veneer, redry veneer, etc.) is introduced into system 100 at input end 102 and then passes longitudinally through system 100 from input end 102 to an output end 104 (FIG. 4). System 100 may comprise a plurality of vertically-spaced and transversely aligned pinch roll assembles (not shown) that define a path of movement for the wood product to be treated to travel. Alternatively, the wood product may be conveyed through system 100 by a single or multiple deck conveyors.

System 100 includes one or more light fixtures 110 and an exhaust system 120 for exhausting gases from system 100. As the wood product to be treated is radiated, moisture is released from the wood product and the volume of gases within system 100 increases resulting in a positive pressure differential within system 100 relative to the external atmosphere. In other words, the pressure within system 100, or components thereof, becomes greater than the pressure external the system. In some embodiments, system 100 includes means (e.g. pressure sensors, blowers, fans, circulating systems, etc.) for maintaining the pressure within the system, or components thereof, within an accurate range of the pressure external the system (i.e. "zero pressure differential"). For example, in some embodiments, exhaust system 120 incudes means for containing and/or treating exhaust gases prior to discharged into the atmosphere (e.g. a volatile organic carbon (V.O.C.) separating device such as a catalytic or thermal oxidizer). In some embodiments, system 100 includes one or more baffle systems (not shown) at input end 102 and/or output end 104 for minimizing or preventing the flow of ambient air into system 100 and/or the flow of gases produced inside system 100 to the atmosphere (i.e. external to system 100). In some embodiments, system 100 includes means for maintaining the temperature of the exhaust gases at or above a minimum operating temperature. At temperatures below the minimum operating temperature, pitch (i.e. condensed V.O.C. material) builds-up in exhaust system 120, representing an obvious fire hazard.

In some embodiments, system 100 includes one or more light fixtures 110*a* positioned proximate to an upper surface of a wood product to be treated and/or one or more light fixtures 110*b* positioned proximate to a lower surface of the wood product. In some embodiments, fixtures 110 are positioned on either or both surfaces of the wood product. To optimize treatment conditions, the distance between fixtures 110 and/or the distance between fixtures 110 the wood product to be treated may be varied. In some embodiments, fixtures 110 are positioned about 6 inches (i.e. about 15 cm) apart from each other. In some embodiments, light fixture(s) 110, 110*a*, 110*b* are in close proximity to the surface of a wood product to be treated, which may pose fire hazards. For example, in some embodiments, each light fixture 110, 110*a*, 110*b* is about 3 inches or less (i.e. about 7.5 cm or less) from the surface of the wood product to be treated. To reduce the risk of fire, in some embodiments, light fixture(s) 110, 110*a*, 110*b* are capable of dissipating heat quickly when the power supply is removed from the light fixture(s). To monitor system 100 for fire, system 100 may include one or more flame detectors (not shown).

Figure 6:
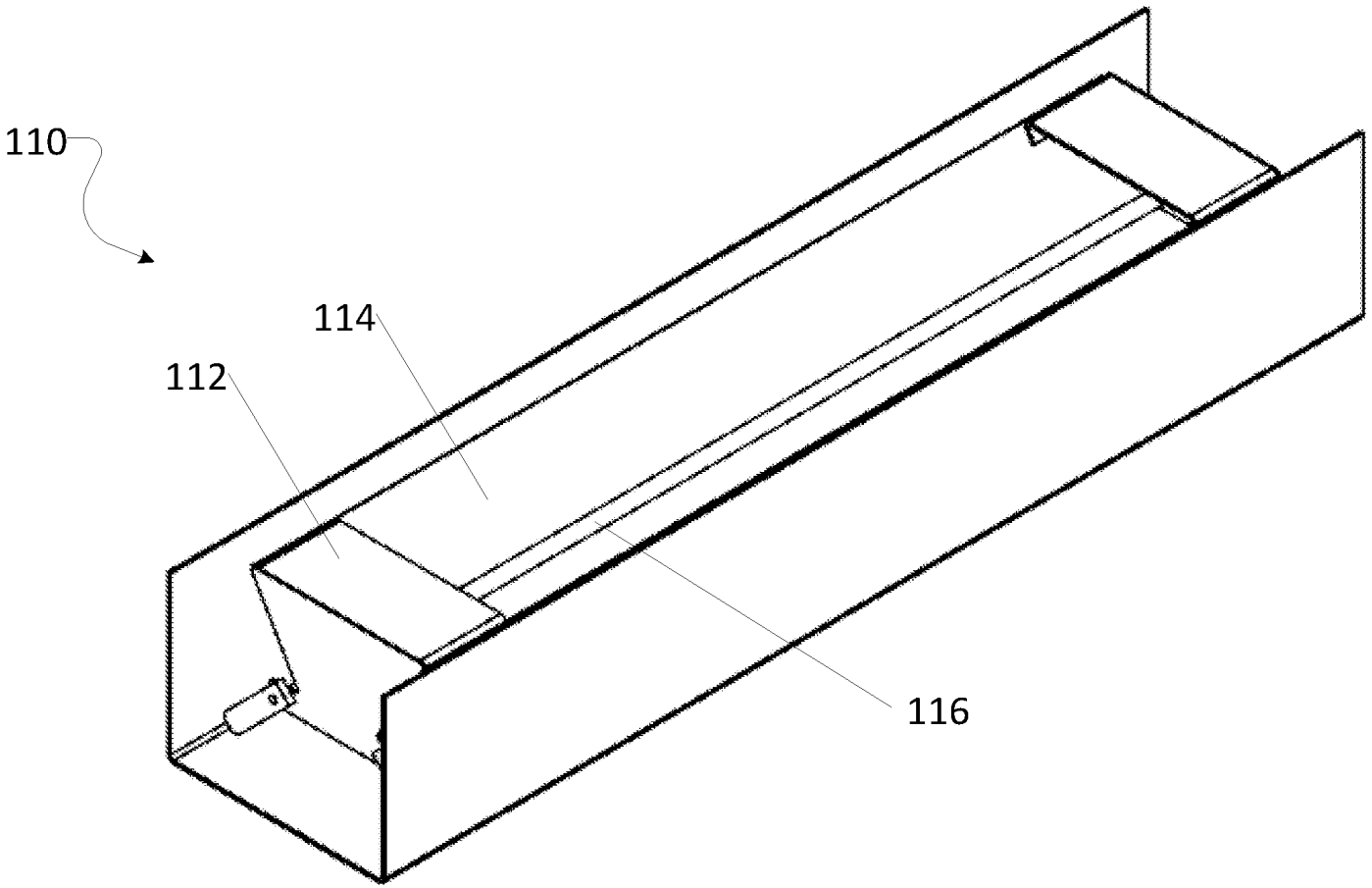
FIG. 6 is a perspective view of a light fixture according to an example embodiment of the present invention.
Figure 7:
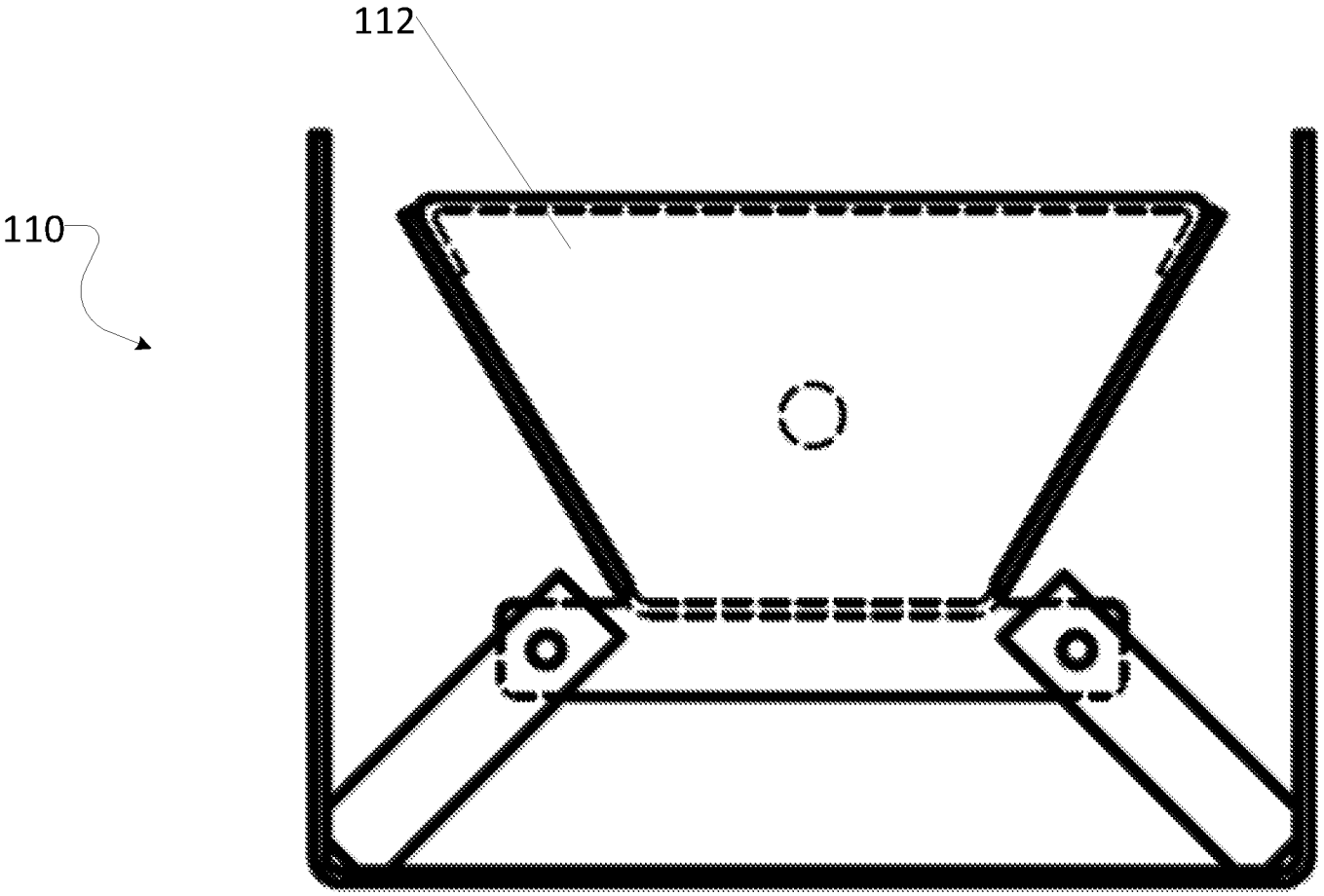
FIG. 7 is a front elevation view of the light fixture shown in FIG. 6.

Each fixture 110, shown in FIGS. 6 and 7, includes a ballast 112 that houses a reflector 114 and a radiation source 116. Source 116 is capable of emitting IR and/or UV radiation. Reflector 114 is mounted to ballast 112 and/or source 116 to direct radiation from source 116 to the wood product to be treated inside system 100. Ballast 112 regulates the current directed to radiation source 116 and/or provides sufficient voltage to operate radiation source 116 and generate a desired output of radiation.

Reflector 114 and source 116 may be selected to optimize treatment conditions of system 100. For example, depending on the wood product to be treated, source 116 may be selected to emit radiation at a specific wavelength or a range of wavelengths. In some embodiments, source 116 emits electromagnetic (EM) radiation having wavelengths of about $1\times10^{-6}$ m to about $4\times10^{-6}$ m (including any value therebetween), which is in the IR range, and/or about $1\times10^{-8}$ m to about $4\times10^{-7}$ m (including any value therebetween), which is in the UV range. In some embodiments, source 116 is a conventional quartz bulb or lamp. Conventional quartz lamps emit EM radiation having wavelengths of about $1\times10^{-6}$ m to about $4\times10^{-6}$ m (including any value therebetween) (i.e. in the IR range). Such lamps may generate temperatures of up to about 200° C. when in use. The radiation wavelength emitted by such lamps may be modified by changing the source filament material used with the quartz bulb (e.g. tungsten, sodium, iridium, etc.). In some embodiments, source 116 may be replaced with a gas-fired infrared heater (not shown) and/or a microwave oscillator tube (not shown). Persons skilled in the art will recognize that the temperature(s) reached and/or EM radiation frequencies generated by system 100 may be modified by varying source 116.

Reflector 114 comprises a reflective surface used to direct radiation. Reflector 114 collects radiation from source 116 to reflect and focus the radiation onto a surface of the wood product to be treated. In some embodiments, reflector 114 comprises a parabolic reflector and the surface thereof is shaped as part of a circular paraboloid (i.e. generated by a parabola revolving around its axis). In some other embodiments, reflector 114 is integral with source 116 and follows the shape of the source. For example, when source 116 comprises a bulb, reflector 114 is not parabolic. Such configuration may improve the focus of radiation. In some embodiments, reflector 114 prevents radiation from source 116 from leaking outside system 100.

In the embodiment illustrated in FIGS. 3-5, system 100 comprises electrical control boxes 150 and conduits for wires 152 to provide and/or control the power input to light fixtures 110. Persons skilled in the art will recognize that the configuration and position of control boxes 150 and/or conduits 152 may be modified without impacting the performance of system 100.

Depending on the dimensions of the wood product to be treated and/or the amount of moisture inside the wood product to be treated and/or the distribution of moisture inside the wood product and/or the type of wood product to be treated, system 100 may be optimized to achieve a desired extent of heat distribution throughout the wood product and/or its surface(s). In some embodiments, it is desirable to distribute heat evenly throughout the wood product. In some embodiments, it is desirable to distribute heat evenly only at one or more surfaces of the wood product. In some embodiments, it is desirable to distribute heat evenly throughout one or more areas of one or more surfaces of the wood product. In some embodiments, it is desirable to distribute heat evenly at one or more surfaces of the wood product to a predetermined depth. In some embodiments, it is desirable to apply heat only to the wettest areas (or other specified area) of a wood product. To achieve the desired heat distribution, one or more of the following components of system 100 may be varied: wavelength of radiation emitted by source(s) 116, treatment time, distance between fixtures 110 and the surface(s) of the wood product to be treated, distance between adjacent fixtures 110 along the direction of travel of the wood product to be treated, EM radiation source (e.g. bulb type), temperature, length of system 100, energy (i.e. wattage and/or power) intensity, type of reflector 114, shape of reflector 114, distance between reflector 114 and corresponding source 116, the material used with any quartz bulb source(s) 116 (e.g. tungsten, sodium, iridium, etc.), and configuration of light fixtures 110. For example, fixtures 110 may be configured to direct radiation to the wettest areas of a wood product.

In some embodiments, the power supplied to one or more fixtures 110 may be varied depending on one or more of the following factors: the dimensions of the wood product to be treated, the amount of moisture inside the wood product to be treated, the distribution of moisture inside the wood product to be treated, and the type of wood product to be treated, treatment time, distance between fixtures 110 and the surface(s) of the wood product to be treated, distance between adjacent fixtures 110 along the direction of travel of the wood product to be treated, EM radiation source (e.g. bulb type), temperature, and length of system 100. In some embodiments, power may be supplied to designated fixtures 110 to direct radiation specifically to the wettest areas of the wood product. In some embodiments, thicker wood products may require an EM radiation source that emits radiation at longer wavelengths than that is required to treat a thinner wood product. In some embodiments, longer wavelengths may be required to penetrate the inside of thicker wood products.

In some embodiments, a dryer control system (not shown) for instantly turning system 100 off are provided. The dryer control system may be used to stop the system if there is a line stoppage inside the dryer In some embodiments, the dryer control system stops power supply to one or more fixtures 110. In some embodiments, user defined inputs drive the functionality of the dryer control system.

Without being bound to theory, it is thought that, in some embodiments, IR radiation penetrates the surface of a wood product and heats the moisture inside the wood product to generate steam. The steam causes pressure to build up inside the wood product, driving the steam towards the wood product's surface. UV radiation at the wood product's surface retains the steam inside the wood product, causing the steam to distribute throughout the wood product. With steam distributed, the pores of the wood product open and the wood product is able to release moisture quickly and, in some embodiments, evenly. Since the wood product and/or its surface(s) is uniformly irradiated with IR and/or UV, moisture inside the wood product is evenly heated and/or distributed and/or released, thereby preventing or minimizing variable distribution of moisture in the treated wood product. Accordingly, in some embodiments, the treated wood product is substantially free of areas of higher moisture (i.e. wet areas) that would otherwise impact the quality of the treated wood product or any products derived therefrom. For example, when an otherwise dry wood veneer is pressed with glue to form a wood veneer panel, any wet areas in the veneer will result in a "blow" or defect due to pressure delamination in those areas.

In some embodiments, radiation from system 100 penetrates the irradiated surface(s) of the wood product being treated up to a depth of between about 0.1 mm to about 1 mm (including any value therebetween). In some embodiments, radiation from system 100 penetrates the irradiated surface(s) of the wood product being treated up to a depth of about 0.3 mm. In some embodiments, the energy (i.e. wattage and/or power) intensity may be varied as the amount of moisture in the wood product treated by system 100 changes. Energy intensity may be more easily varied in system 100 than in the dryer (e.g. dryer 10).

Figure 8:
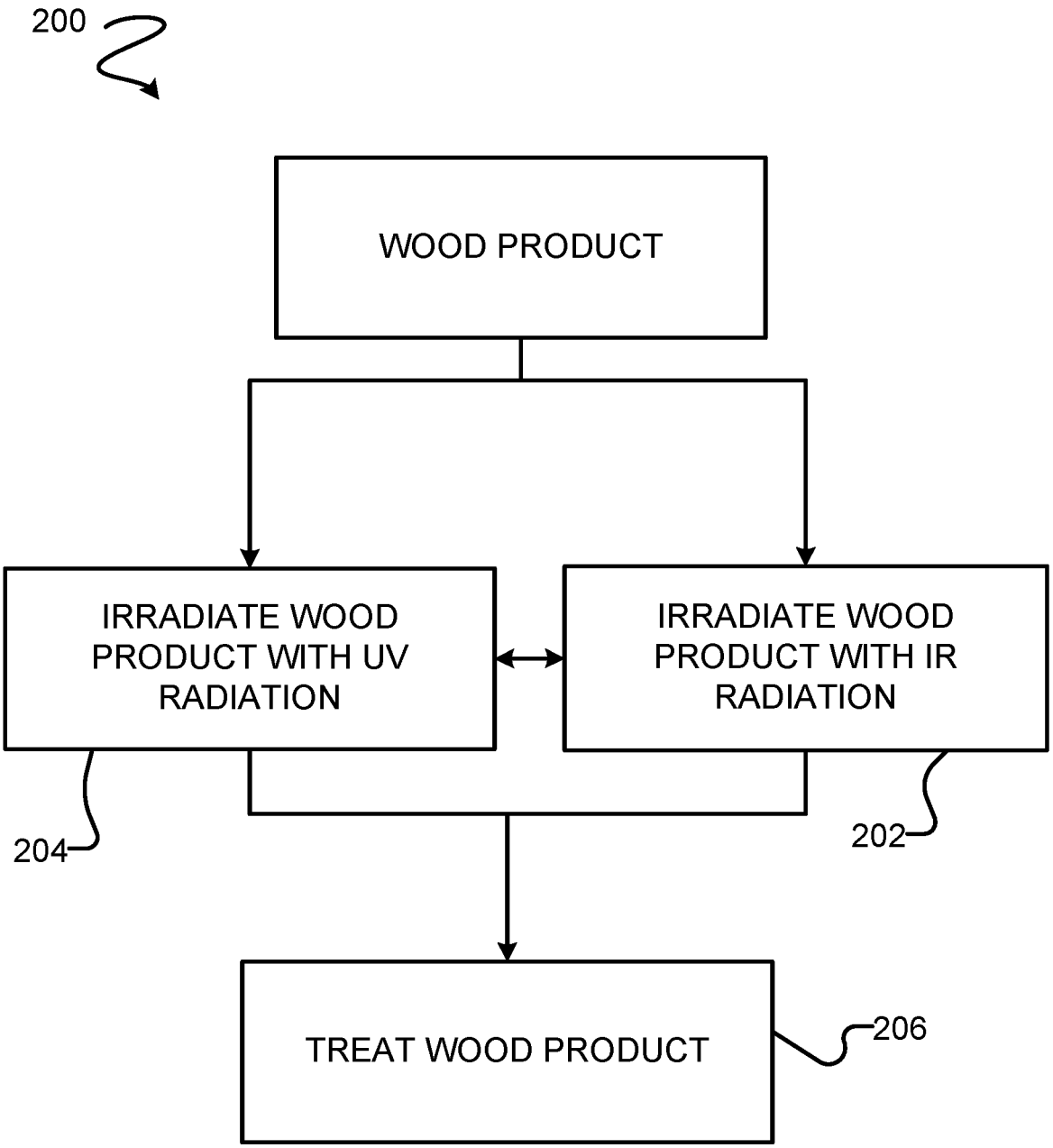
FIG. 8 is a flow chart illustrating a method for treating a wood product.

FIG. 8 shows a method 200 of preconditioning a wood product to be treated using system 100. At step 202, the wood product is conveyed through system 100 and one or more surfaces (or one or more areas of the one or more surfaces) of the wood product are irradiated with IR radiation. In some embodiments, one or more surfaces of the wood product are irradiated with UV radiation at step 204. In some embodiments, the wood product is irradiated first with IR radiation and then with UV radiation, first with UV radiation and then with IR radiation, or with UV and IR radiation simultaneously. At step 206, the preconditioned wood product is further treated (e.g. the preconditioned wood product is conveyed through a dryer).

The intensity of radiation (i.e. applied heat) used in system 100 is more easily adjusted than the heat inside a conventional jet tube dryer. Further, the radiation (i.e. heat) applied to a wood product using system 100 is more uniform than the heat applied to a wood product inside a conventional jet tube dryer. By uniformly irradiating the wood product with IR and/or UV radiation prior to further treatment, wood product treatment (e.g. drying) times may be reduced and/or wood product treatment energy requirements may be reduced and/or wood product treatment sections (e.g. dryer sections) may be shortened and/or further treatment productivity may be improved and/or the quality of the treated wood product may be improved. For example, the amount of redry may be reduced by preconditioning the wettest areas of green wood veneer using system 100. Depending on the moisture levels of the veneer preconditioned using system 100, the intensity of radiation may be varied to achieve a more even distribution of moisture prior to subsequent treatment. Varying the radiation intensity of system 100 may be more easily accomplished than the process conditions of subsequent treatment steps/equipment (e.g. varying the heat applied to a wood product inside a conventional jet tube dryer).

As an example, when the wood product to be treated is green wood veneer, the amount of redry may be reduced by using system 100 prior to drying the veneer in a conventional veneer dryer (e.g. dryer 10). Wood product exiting the dryer may be tested for quality using a moisture meter conventionally known. The moisture meter looks for wet spots in the wood product. For example, if veneer has too many wet spots after drying, it is generally unsuitable for use in composite wood products (CWPs). Wet spots may delaminate layers in the CWP. In some embodiments, one or more jet tubes inside the veneer dryer (e.g. dryer 10) may be replaced with fixture(s) 110.

Figure 9:
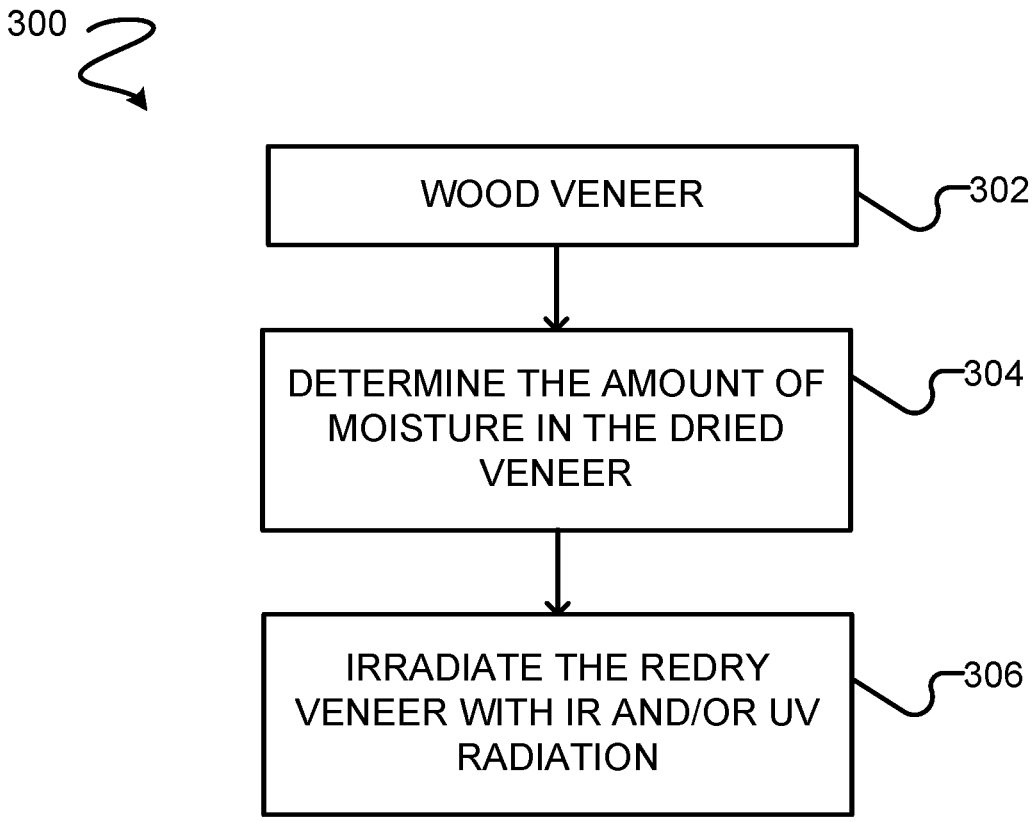
FIG. 9 is a flow chart illustrating a method of redrying wood veneer.

FIG. 9 shows a method 300 of drying redry veneer using system 100. At step 302, green wood veneer is conveyed through a dryer to remove moisture from the veneer. At step 304, dried wood veneer exits the dryer at an output end and the amount of moisture in the wood veneer is accessed using a moisture meter. At step 306, redry veneer having a predetermined moisture amount is conveyed through system 100 and irradiated with IR and/or UV radiation. In some embodiments, a metriguard is used to access the quality of the veneer. Metriguards are conventionally used to determine the quality grade of veneer. Not all veneer requires grading for its intended purpose.

In some embodiments, system 100 is used to heat and cure composite wood products (CWPs). In some embodiments, system 100 is used to heat the surface of wood-concrete composite products (WCCPs) so that the WCCP can be coated with a resin or other coating.

Conventional CWPs are made with a thermosetting (i.e. heat-curing) resin and/or a UV-curing resin and/or an adhesive that holds the wood together. CWPs are typically thicker than veneer and due to the dimensions of these materials. Thus, CWPs often take longer periods of time than sheet materials (e.g. veneer) to heat to a temperature sufficient to cure the resin and/or adhesive. System 100 may be used to treat a CWP. The CWP is conveyed through system 100 and irradiated with IR and/or UV radiation. In some embodiments, the CWP is first irradiated with IR radiation and subsequently irradiated with UV radiation. In some embodiments, the CWP is first irradiated with UV radiation and subsequently irradiated with IR radiation. In some embodiments, the CWP is irradiated simultaneously with IR and UV radiation. IR and/or UV radiation penetrates the CWP and heats the resin and/or adhesive from the inside out to cure the resin and/or adhesive evenly throughout the CWP. The temperature of system 100 may be optimized to cause the resin and/or adhesive to cure evenly throughout the CWP. In some embodiments, the temperature of system 100 is greater than about 78° C. to cause the resin and/or adhesive to evenly crosslink and increase the strength of the CWP. To avoid burning the surface of the CWP during treatment, the temperature of system 100 may be controlled. In some embodiments, the temperature of system 100 depends on the dimensions of the CWP and/or the type of the CWP and/or the type of resin and/or adhesive. In some embodiments, the temperature of system 100 is kept below about 120° C. System 100 is capable of increasing the temperature of the CWP from the inside out to achieve a uniform distribution of heat throughout the CWP and/or its surface(s) to cure the resin and/or adhesive in a manner that is time and energy efficient in comparison with conventional methods of curing resins and adhesives.

Wood-concrete composite products (WCCPs) are conventionally coated with a thermosetting (i.e. heat-curing) resin and/or a UV-curing resin by first heating the entire product and then applying the resin to the surface of the heated product. Due to the dimensions of the WCCP, it can take a long period of time for the product to cool after coating. System 100 may be used to precondition a WCCP for coating. The WCCP is conveyed through system 100 and irradiated with IR and/or UV radiation. In some embodiments, the WCCP is first irradiated with IR radiation and subsequently irradiated with UV radiation. In some embodiments, the WCCP is first irradiated with UV radiation and subsequently irradiated with IR radiation. In some embodiments, the WCCP is irradiated simultaneously with IR and UV radiation. IR and/or UV radiation penetrates only the surface of the product to evenly distribute heat to the surface of the WCCP before a coating is applied. Once the WCCP has been preconditioned by system 100, the coating is applied.

Since only the surface of the WCCP is heated, the product cools relatively quickly compared with conventional methods of coating WCCPs. Accordingly, the WCCP may be preconditioned using system 100 to avoid or minimize undesirable delays while waiting for the WCCP to cool before moving onto the next stage of processing. The depth to which radiation generated by system 100 is able to penetrate the WCCP may be optimized, as described elsewhere herein, to avoid unnecessarily heating the WCCP throughout and to focus heat on only the surface of the product. Also, energy is saved since no more of the WCCP is heated than is necessary to cure the resin coating.

System 100 is not limited to the treatment of wood products. In some embodiments, system 100 may be used to precondition (i.e. remove moisture, as described elsewhere herein) one or more of wood, lumber, wood veneer, gypsum, foodstuffs, marijuana, tobacco, pharmaceuticals, powders, grains, paper, sewage sludge, paint, glass, plastics, ink, adhesives, and clothes before further treatment (e.g. drying).

Example 1

The thickness, length, width, and weight of a sheet of green wood veneer were determined (Table 1). The veneer was conveyed through system 100 and irradiated with IR radiation. The system conveying speed, irradiation time, power/voltage, energy, and current were determined (Table 2). The thickness, length, width, and weight of the preconditioned wood veneer were determined (Table 3). Shrinkage was determined by comparing the width of the preconditioned wood veneer ($w_{preconditioned}$) to the width of the green wood veneer ($w_{green}$) (i.e. shrinkage=$(1-w_{preconditioned}/w_{green})\times 100\%$). Shrinkage may be used to assess the moisture content of a wood product. The preconditioned wood veneer was then re-conveyed through system 100 and irradiated with IR radiation until dry. The system conveying speed, irradiation time, power/voltage, energy, and current were determined (Table 4). The thickness, length, width, and weight of the dry wood veneer were determined (Table 5). The weight of water extracted from the green wood veneer via preconditioning using system 100 and the effectiveness of system 100 in preconditioning the green wood veneer were determined (Table 6). The weight of water extracted from the preconditioned wood veneer via further drying using system 100 and the effectiveness of system 100 in redrying preconditioned wood veneer were determined (Table 7). The effectiveness of system 100 was assessed based on: (i) the specific energy (i.e. the amount of energy used to dry the green wood veneer (i.e. current×voltage) divided by the weight of extracted water); and (ii) the drying rate (i.e. the amount of water removed as a function of the time required to remove the water).

TABLE 1

| Green wood veneer | | | | |
|---|---|---|---|---|
| Sheet | Weight (lb) | Thickness (inches) | Length (inches) | Width (inches) |
| 1 | 31 5/16 | 0.1 | 101 1/4 | — |
| 2 | 33 3/16 | 0.1 | 101 1/4 | — |
| 3 | 31 13/16 | 0.1 | 101 1/4 | — |
| 4 | 33 3/16 | 0.1 | 101 1/4 | — |
| 5 | 29 | 0.1 | 101 1/4 | 53 1/2 |
| 6 | 32 11/16 | 0.1 | 101 1/4 | — |
| 7 | 33 9/16 | 0.1 | 101 1/4 | 53 5/8 |
| 8 | 29 13/16 | 0.1 | 101 1/4 | 53 3/8 |
| 9 | 32 1/2 | 0.1 | 101 1/4 | 53 1/2 |
| 10 | 32 5/16 | 0.1 | 101 1/4 | 53 3/8 |
| 11 | 33 5/8 | 0.1 | 101 1/4 | 53 1/2 |

TABLE 1-continued

| Green wood veneer | | | | |
|---|---|---|---|---|
| Sheet | Weight (lb) | Thickness (inches) | Length (inches) | Width (inches) |
| 12 | 31¾ | 0.1 | 101¼ | 53¼ |
| 13 | 33 1/16 | 0.1 | 101¼ | 53¼ |
| 14 | 31 9/16 | 0.1 | 101¼ | 53⅜ |
| 15 | 28⅝ | 0.1 | 101¼ | 53¼ |
| 16 | 27 5/16 | 0.1 | 101¼ | 53¼ |
| 17 | 26⅝ | 0.1 | 101¼ | 53¼ |
| 18 | 27 5/16 | 0.1 | 101¼ | 53⅜ |
| 19 | 28 13/16 | 0.1 | 101¼ | 53¼ |
| 20 | 31 9/16 | 0.1 | 101¼ | 53¼ |
| 21 | 31 11/16 | 0.1 | 101¼ | 53⅜ |

TABLE 2

| Green wood veneer preconditioning | | | | | | |
|---|---|---|---|---|---|---|
| Sheet | Conveyor Speed (ft/min) | Pre-conditioning Time (min) | Number of IR Fixtures* | Current (A) | Power (kW) | Energy (MJ) |
| 1 | — | 8:01 | 5 | 62.5 | 28.44 | 13.7 |
| 2 | 2.0 | 3:18 | 5 | 62.5 | 28.44 | 5.6 |
| 3 | 2.0 | 3:17 | 5 | 62.5 | 28.44 | 5.6 |
| 4 | 1.6 | 3:42 | 5 | 62.5 | 28.44 | 6.3 |
| 5 | — | 3:25 | 5 | 62.5 | 28.44 | 5.8 |
| 6 | — | 5:49 | 5 | 62.5 | 28.44 | 9.9 |
| 7 | 1.0 | 6:06 | 5 | 62.5 | 28.44 | 10.4 |
| 8 | 4.5 | 1:27 | 5 | 62.5 | 28.44 | 2.5 |
| 9 | 1.0 | 6:34 | 4 | 50 | 22.75 | 9.0 |
| 10 | — | 7:09 | 4 | 50 | 22.75 | 9.8 |
| 11 | 1.3 | 5:03 | 4 | 50 | 22.75 | 6.9 |
| 12 | 1.0 | 6:22 | 4 | 50 | 22.75 | 8.7 |
| 13 | 1.1 | 6:17 | 4 | 50 | 22.75 | 8.6 |
| 14 | 1.0 | 6:34 | 4 | 50 | 22.75 | 9.0 |
| 15 | 1.1 | 5:52 | 4 | 50 | 22.75 | 8.0 |
| 16 | 3.3 | 1:53 | 4 | 50 | 22.75 | 2.6 |
| 17 | — | 2:45 | 4 | 50 | 22.75 | 3.8 |
| 18 | 2.1 | 3:06 | 4 | 50 | 22.75 | 4.2 |
| 19 | 2.2 | 2:52 | 4 | 50 | 22.75 | 3.9 |
| 20 | 2.2 | 2:57 | 4 | 50 | 22.75 | 4.0 |
| 21 | — | — | 4 | 50 | 22.75 | — |

*The number of IR fixtures used to irradiate each of the top and bottom surfaces of the veneer.

TABLE 3

| Preconditioned wood veneer | | | | | |
|---|---|---|---|---|---|
| Sheet | Weight (lb) | Thickness (inches) | Length (inches) | Width (inches) | Shrinkage (%) |
| 1 | 27 11/6 | 0.1 | — | — | — |
| 2 | 29 13/16 | — | — | — | — |
| 3 | 27¾ | — | — | — | — |
| 4 | 29½ | — | — | — | — |
| 5 | 25 13/16 | — | — | — | — |
| 6 | 26⅜ | — | — | — | — |
| 7 | — | — | — | — | — |
| 8 | — | — | — | — | — |
| 9 | — | — | — | — | — |
| 10 | — | — | — | — | — |
| 11 | 26 13/16 | — | — | 52⅞ | 1.2 |
| 12 | 25 7/16 | — | — | 52⅛ | 2.1 |
| 13 | 26 15/16 | — | — | 52⅝ | 1.2 |
| 14 | — | — | — | — | — |
| 15 | 25⅜ | — | — | 51⅝ | 3.1 |
| 16 | 24⅝ | — | — | 53 | 0.5 |
| 17 | 24⅜ | — | — | 52⅝ | 1.2 |
| 18 | 24⅝ | — | — | 52¾ | 1.2 |
| 19 | 26 1/16 | — | — | 52¾ | 0.9 |

TABLE 3-continued

| Preconditioned wood veneer | | | | | |
|---|---|---|---|---|---|
| Sheet | Weight (lb) | Thickness (inches) | Length (inches) | Width (inches) | Shrinkage (%) |
| 20 | 28 7/16 | — | — | 52⅞ | 0.7 |
| 21 | — | — | — | — | — |

TABLE 4

| Preconditioned wood veneer drying | | | | | | |
|---|---|---|---|---|---|---|
| Sheet | Conveyor Speed (ft/min) | Drying Time (min) | Number of IR Fixtures* | Current (A) | Power (kW) | Energy (MJ) |
| 1 | — | — | 5 | 62.5 | 28.44 | — |
| 2 | — | 3:12 | 5 | 62.5 | 28.44 | 5.5 |
| 3 | — | 5:51 | 5 | 62.5 | 28.44 | 10.0 |
| 4 | — | 5:22 | 5 | 62.5 | 28.44 | 9.2 |
| 5 | — | — | 5 | 62.5 | 28.44 | — |
| 6 | 2.9 | 1:45 | 5 | 62.5 | 28.44 | 3.4 |
| 7 | — | — | 5 | 62.5 | 28.44 | — |
| 8 | — | — | 5 | 62.5 | 28.44 | — |
| 9 | — | — | 4 | 50 | 22.75 | — |
| 10 | — | — | 4 | 50 | 22.75 | — |
| 11 | 1.0 | 1:48 | 4 | 50 | 22.75 | 9.0 |
| 12 | 2.1 | 2:19 | 4 | 50 | 22.75 | 3.4 |
| 13 | 3.0 | — | 4 | 50 | 22.75 | 3.1 |
| 14 | — | — | 4 | 50 | 22.75 | — |
| 15 | — | — | 4 | 50 | 22.75 | — |
| 16 | — | — | 4 | 50 | 22.75 | — |
| 17 | 3.3 | 1:59 | 4 | 50 | 22.75 | 2.7 |
| 18 | — | 1:53 | 4 | 50 | 22.75 | 2.6 |
| 19 | — | 2:23 | 4 | 50 | 22.75 | 3.3 |
| 20 | 3.4 | 1:55 | 4 | 50 | 22.75 | 2.6 |
| 21 | — | — | 4 | 50 | 22.75 | — |

*The number of IR fixtures used to irradiate each of the top and bottom surfaces of the veneer.

TABLE 5

| Dry wood veneer | | | | | |
|---|---|---|---|---|---|
| Sheet | Weight (lb) | Thickness (inches) | Length (inches) | Width (inches) | Shrinkage (%) |
| 1 | 25⅛ | 0.1 | — | 13 | — |
| 2 | 26 5/16 | — | — | — | — |
| 3 | 23 15/16 | — | — | — | — |
| 4 | 24⅞ | — | 101¼ | 51 9/16 | — |
| 5 | 23 3/16 | — | — | — | — |
| 6 | — | — | — | — | — |
| 7 | — | — | — | — | — |
| 8 | — | — | — | — | — |
| 9 | — | — | — | — | — |
| 10 | — | — | — | — | — |
| 11 | — | — | — | — | — |
| 12 | 23 15/16 | — | — | — | — |
| 13 | 24 15/16 | — | — | — | — |
| 14 | — | — | — | — | — |
| 15 | — | — | — | — | — |
| 16 | — | — | — | — | — |
| 17 | 22⅞ | — | — | 51¾ | 2.8 |
| 18 | 23 | — | — | 51½ | 3.5 |
| 19 | 23⅝ | — | — | 51⅞ | 2.6 |
| 20 | — | — | — | 52¾ | 0.9 |
| 21 | — | — | — | — | — |

TABLE 6

System 100 effectiveness (green wood veneer preconditioning)

| Sheet | Time (min:s) | Water Weight (lb) | Drying Rate (lb/min) | Effectiveness (Specific Energy/Water Weight) (MJ/lb) |
|---|---|---|---|---|
| 1 | 8:01 | 2 9/16 | 0.5 | 3.8 |
| 2 | 3:18 | 3 1/2 | 1.0 | 1.7 |
| 3 | 3:17 | 3 13/16 | 1.2 | 1.4 |
| 4 | 3:42 | 4 5/8 | 1.0 | 1.7 |
| 5 | 3:25 | 2 5/8 | 0.9 | 1.8 |
| 6 | 5:49 | — | 1.1 | 1.6 |
| 7 | 6:06 | — | — | — |
| 8 | 1:27 | — | — | — |
| 9 | 6:34 | — | — | — |
| 10 | 7:09 | — | — | — |
| 11 | 5:03 | — | 1.3 | 1.0 |
| 12 | 6:22 | 1 1/2 | 1.0 | 1.4 |
| 13 | 6:17 | 2 | 1.0 | 1.4 |
| 14 | 6:34 | — | — | — |
| 15 | 5:52 | — | 0.6 | 2.5 |
| 16 | 1:53 | — | 1.4 | 1.0 |
| 17 | 2:45 | 1 1/2 | 0.8 | 1.7 |
| 18 | 3:06 | 1 5/8 | 0.9 | 1.6 |
| 19 | 2:52 | 2 7/16 | 1.0 | 1.4 |
| 20 | 2:57 | — | 1.1 | 1.3 |
| 21 | 8:01 | — | 0.5 | 3.8 |

TABLE 7

System 100 effectiveness (preconditioned wood veneer drying)

| Sheet | Time (min:s) | Water Weight (lb) | Drying Rate (lb/min) | Effectiveness (Specific Energy/Water Weight) (MJ/lb) |
|---|---|---|---|---|
| 1 | — | 2 9/16 | — | 1.6 |
| 2 | 3:12 | 3 1/2 | 1.1 | 2.6 |
| 3 | 5:51 | 3 13/16 | 0.7 | 2.0 |
| 4 | 5:22 | 4 4/8 | 0.9 | — |
| 5 | — | 2 5/8 | — | — |
| 6 | 2:00 | — | — | — |
| 7 | — | — | — | — |
| 8 | — | — | — | — |
| 9 | — | — | — | — |
| 10 | — | — | — | — |
| 11 | 6:34 | — | — | — |
| 12 | 2:28 | 1 1/2 | 0.6 | 2.2 |
| 13 | 2:15 | 2 | 0.9 | 1.5 |
| 14 | — | — | — | — |
| 15 | — | — | — | — |
| 16 | — | — | — | — |
| 17 | 1:59 | 1 1/2 | 0.8 | 1.8 |
| 18 | 1:53 | 15/8 | 0.9 | 1.6 |
| 19 | 2:23 | 2 7/16 | 1.0 | 1.3 |
| 20 | 1:55 | — | — | — |
| 21 | — | — | — | — |
| Average | — | — | 1.73 | 0.93 |

Example 2

The effectiveness of system 100 was compared to that of a conventional jet tube veneer dryer based on specific energy (i.e. the amount of energy used to dry green wood veneer (i.e. current×voltage) divided by the weight of extracted water. The conventional dryer was a six deck conveyor dryer having a length of 120 feet (i.e. about 36.6 meters). System 100 was a single deck conveyor having a length of 48.625 inches (i.e. about 123.5 cm).

The conventional dryer removed about 27.5 lb/ft$^3$ of water from green wood veneer at a rate of about 614.6 ft$^3$/hour. The drying rate of the conventional dryer was about 281.7 lb/min. Per deck and length, the drying rate of the conventional dryer was about 0.4 lb/(ft·min). The specific energy of the conventional dryer was determined to be about 1.5 MJ/lb. This value was determined by dividing the conventional dryer's theoretical heat rate before losses of 24 MMBTU/hr by 281.7 lb/min. The drying rate of system 100 was about 0.93 lb/min. Per deck and length, the drying rate of system 100 was about 0.23 lb/(ft·min). The specific energy of system 100 was determined to be about 1.73 MJ/lb. Accordingly, system 100 was determined to be more effective in removing moisture from green wood veneer than the conventional dryer. System 100 was determined to be about 87% efficient, which is expected to exceed the efficiency of the conventional dryer.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

INTERPRETATION OF TERMS

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a substrate, assembly, device, manifold, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments described herein.

Specific examples of systems, methods, and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

The invention claimed is:

1. A method for treating a wood product, the method comprising:

preconditioning the wood product by irradiating one or more surfaces of the wood product with infrared (IR) and ultraviolet (UV) radiation; and subsequently treating the wood product, wherein the IR radiation has a wavelength between about $7\times10^{-7}$ m and about $1\times10^{-3}$ m, and wherein the UV radiation has a wavelength between about $1\times10^{-8}$ m and about $4\times10^{-7}$ m.

2. The method according to claim 1, wherein the one or more surfaces of the wood product is first irradiated with IR radiation and subsequently irradiated with UV radiation.

3. The method according to claim 1, wherein the one or more surfaces of the wood product is first irradiated with UV radiation and subsequently irradiated with IR radiation.

4. The method according to claim 1, wherein the one or more surfaces of the wood product is irradiated with IR radiation and UV radiation simultaneously.

5. The method according to claim 1, wherein the one or more surfaces of the wood product is irradiated with IR and UV radiation for a time sufficient to distribute moisture throughout the wood product and/or the one or more surfaces of the wood product.

6. The method according to claim 1, wherein one or more areas of the one or more surfaces of the wood product is irradiated with IR and UV radiation for a time sufficient to distribute moisture throughout the wood product and/or the one or more surfaces of the wood product.

7. The method according to claim 1, wherein subsequently treating the wood product comprises one or more of drying, heating, curing, coating, and pressure-treating.

8. The method according to claim 1, wherein the wood product comprises one or more of green wood veneer, redry wood veneer, plywood, particleboard, fiberboard, hardboard, oriented strand board, laminated timber, laminated veneer, cross laminated, parallel strand, laminated strand, finger joint, beams, trusses, transparent wood composites, wood-concrete composites, wood-plastic composites (WPCs), and wood gypsum composites.

9. The method according to claim 1, wherein the method further comprises determining the amount of moisture in the wood product prior to irradiating the one or more surfaces of the wood product.

10. The method according to claim 9, wherein the amount of moisture in the wood product is greater than or equal to about 10% by weight.

11. The method according to claim 1, wherein irradiating the one or more surfaces of the wood product comprises varying the energy intensity of the UV and IR radiation depending on the amount of moisture in the wood product.

* * * * *